US005196299A

United States Patent [19]

Dickerson et al.

[11] Patent Number: 5,196,299

[45] Date of Patent: Mar. 23, 1993

[54] TABULAR GRAIN EMULSION CONTAINING RADIOGRAPHIC ELEMENTS EXHIBITING REDUCED DYE STAIN

[75] Inventors: Robert E. Dickerson; Steven G. Link; Fred M. Macon, all of Rochester; Richard B. Anderson, Fairport; Wayne W. Weber, II, Honeoye Falls, all of N.Y.

[73] Assignee: Eastman Kodak Company, Rochester, N.Y.

[21] Appl. No.: 677,004

[22] Filed: Mar. 28, 1991

[51] Int. Cl.[5] ..... G03C 1/18; G03C 1/46

[52] U.S. Cl. ..... 430/567; 430/502; 430/568; 430/588; 430/963; 430/966

[58] Field of Search ..... 430/502, 567, 568, 588, 430/966, 963

[56] References Cited

U.S. PATENT DOCUMENTS

| | | | |
|---|---|---|---|
| 3,348,949 | 10/1967 | Bannert et al. | 430/588 |
| 3,623,883 | 11/1971 | Bannert et al. | 430/588 |
| 3,933,507 | 1/1976 | von Konig et al. | 430/570 |
| 4,425,425 | 1/1984 | Abbott et al. | 430/502 |
| 4,425,426 | 1/1984 | Abbott et al. | 430/502 |
| 4,510,235 | 4/1985 | Ukai et al. | 430/574 |
| 4,801,526 | 1/1989 | Yoshida et al. | 430/567 |
| 4,837,140 | 6/1989 | Ikeda et al. | 430/550 |
| 4,897,340 | 1/1990 | Ohtani et al. | 430/966 |

FOREIGN PATENT DOCUMENTS

| | | |
|---|---|---|
| 648981 | 6/1964 | Belgium . |
| 1231079 | 5/1971 | United Kingdom . |

*Primary Examiner*—Charles L. Bowers, Jr.
*Assistant Examiner*—Janet C. Baxter
*Attorney, Agent, or Firm*—Carl O. Thomas

[57] ABSTRACT

A radiographic element is disclosed comprised of a transparent film support and spectrally sensitized tabular grain silver halide emulsion layer units coated on opposite sides of the film support. At least one of the emulsion layer units is comprised of tabular grains having a thickness of less than 0.2 micrometer accounting for greater than 50 percent of total grain projected area and exhibiting an average tabularity of greater than 25. Adsorbed to the surface of the tabular grains is at least one benzimidazolocarbocyanine dye chosen for its high level of absorption in the mid-green spectral region at the emission line of gadolinium oxysulfide, terbium activated intensifying screens and its low residual stain in the fully processed film.

12 Claims, No Drawings

TABULAR GRAIN EMULSION CONTAINING RADIOGRAPHIC ELEMENTS EXHIBITING REDUCED DYE STAIN

FIELD OF THE INVENTION

This invention relates to radiographic elements containing at least two imaging portions separated by a transparent film support containing spectrally sensitized tabular grain silver halide emulsions.

BACKGROUND OF THE INVENTION

Abbott et al U.S. Pat. Nos. 4,425,425 and 4,425,426 (Reexamination Certificate 907) taught that the speed-crossover relationship of radiographic elements containing imaging units coated on opposite sides of a film support (hereinafter also referred to as dual coated radiographic elements) can be improved by employing one or more spectrally sensitized high tabularity silver halide emulsions. High tabularity silver halide emulsions are those in which the tabular grains exhibit a mean tabularity (T) of greater than 25, T being defined by the relationship:

$$T=D/t^2 \quad \text{(R1)}$$

where

D is the effective circular diameter (ECD) in micrometers of the tabular grains and t is the thickness in micrometers of the tabular grains.

When spectrally sensitized tabular grain emulsions are compared to nontabular grain emulsions in a dual coated radiographic element format, spectrally sensitized tabular grain emulsions produce reduced crossover as compared to nontabular grain emulsions of matched sensitivity (speed) and increased speed as compared to nontabular grain emulsions exhibiting matched grain surface area. Based on this speed-crossover relationship advantage as well as a number of other advantages, including improved speed-granularity relationships, increased silver image covering power both on an absolute basis and as a function of binder hardening (allowing simplification of processing), more rapid developability, and increased thermal stability, tabular grain emulsions in general and high tabularity emulsions in particular have found wide acceptance.

Notwithstanding the numerous advantages of dual coated radiographic elements containing spectrally sensitized tabular grain emulsions, a disadvantage has arisen in attempting to employ tabular grain emulsions having mean tabular grain thicknesses of less than 0.2 micrometer (hereinafter also referred to as thin tabular grain emulsions) in that staining of the fully processed radiographic elements can occur, attributable to failure to remove the spectral sensitizing dye or dyes adequately during processing. The reason for increased dye stain is that the surface area of thin tabular grains is quite high in relation to their volume. On the other hand, to be effective as a sensitizer the ratio of a dye to grain surface area must be at least 30 percent of monomolecular coverage, where "monomolecular coverage" indicates the amount of dye required to provide a layer one molecule thick over the entire surface area of the silver halide grains present in an emulsion. In a number of instances the thicknesses of tabular grains selected for tabular grain emulsions have been increased, with consequent performance degradation attributable to the consequent reduction in grain tabularity, so that the grain surface area per silver mole in the coatings is reduced and the amount of spectral sensitizing dye can be reduced to achieve tolerable stain levels while retaining high levels of spectrally sensitized speed. This balancing fails to achieve the full advantages that would otherwise be available for thin, high tabularity tabular grain emulsions.

As dual coated radiographic elements are most commonly employed, each element is mounted between a pair of intensifying screens for exposure. An imagewise pattern of X-radiation striking the screens causes them to emit longer wavelength radiation that is primarily responsible for producing the developable latent image in the dual coated radiographic element. Since the ability of silver halide to absorb X-radiation directly is limited, the presence of the screens greatly increases the imaging speed of the system and as a result greatly reduces patient exposure to X-radiation during diagnostic imaging.

Among the most efficient and widely used of phosphors for constructing intensifying screens are terbium activated gadolinium oxysulfide phosphors. These phosphors emit principally in the 540 to 555 nm region, exhibiting a peak emission at 545 nm. To capture efficiently the light emitted by these phosphors when incorporated in intensifying screens it is necessary to choose one or a combination of spectral sensitizing dyes for incorporation in the imaging emulsion layers that exhibit peak light absorption in the same spectral region in which the phosphors exhibit peak emission.

Spectral sensitizing dyes are adsorbed to silver halide grain surfaces to permit the grains to form a developable latent image when exposed to electromagnetic radiation in a spectral region to which the silver halide grains lack native sensitivity. Spectral sensitizing dyes are almost universally chosen from among polymethine dyes and are most typically cyanine or merocyanine dyes. Benzimidazolocarbocyanine dyes are very efficient at utilizing light energy and their high basicity allows them to be protonated and removed in processes which use acidic solutions, leaving low residual stain. These dyes function best as J-aggregates on the silver halide grain surface. Such benzimidazolocarbocyanine aggregates, however, generally absorb light at 560 to 590 nm, the long green region of the spectrum. As such, it has been heretofore necessary to use a different class of dyes, e.g. the oxacarbocyanines or benzimidazolooxacarbocyanines, for sensitization in the mid-green region. These dyes, however, being less basic tend to leave unacceptably high levels of retained dye after processing. Another disadvantageous feature of many benzimidazolo-carbocyanines is their relatively low oxidation potential, which can lead to poor storage stability of the radiographic elements in which they are incorporated. This poor keeping is observed as an increase in fog and/or a loss of photographic speed with storage or incubation of the photographic material.

Known benzimidazolocarbocyanine, oxacarbocyanine, and benzimidazolooxacarbocyanine dyes are illustrated by Abbott et al U.S. Pat. Nos. 4,425,425 and 4,425,426 (Reexamination Certificate 907); Ukai et al U.S. Pat. No. 4,510,235; and Ikeda et al U.S. Pat. No. 4,837,140.

RELATED PATENT APPLICATION

Anderson et al U.S. Ser. No. 676,913 concurrently filed and commonly assigned, discloses photographic materials containing benzimidazolocarbocyanine dyes.

SUMMARY OF THE INVENTION

In one aspect this invention is directed to a radiographic element comprised of a transparent film support and spectrally sensitized tabular grain silver halide emulsion layer units coated on opposite sides of the film support. At least one of the emulsion layer units is comprised of tabular grains having a thickness of less than 0.2 micrometer accounting for greater than 50 percent of total grain projected area and exhibiting an average tabularity of greater than 25. Adsorbed to the surface of the tabular grains is at least one benzimid-azolocarbocyanine dye of the formula:

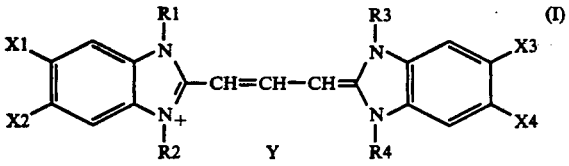

where

R1 and R3 are methyl or ethyl, at least one of R1 and R3 being methyl;

R2 and R4 are substituted or unsubstituted $C_1$ to $C_6$ alkyl, provided that R2 and R4 are not both methyl;

X1, X2, X3, and X4 are each independently methyl, methylthio, fluoro-substituted methyl or methylthio, or hydrogen, provided that at least one of X1 and X2 and at least one of X3 and X4 are not hydrogen; and Y represents an ion as needed to balance the charge of the molecule.

The dual coated radiographic elements of the invention are capable of achieving the full advantages of high tabularity silver halide emulsions while at the same time exhibiting both high levels of sensitivity in the 540 to 555 nm region of the spectrum and very low levels of residual dye stain after processing. The dual coated radiographic elements are also very stable upon storage.

DESCRIPTION OF PREFERRED EMBODIMENTS

The invention is directed to an improvement in the properties of dual coated radiographic films containing one or more thin tabular grain, high tabularity silver halide emulsions exhibiting a high sensitivity to the mid-green portion of the visible spectrum. As employed herein, the term "mid-green" refers to the 540 to 555 nm portion of the electromagnetic spectrum. The radiographic elements of the invention are comprised of a transparent film support and spectrally sensitized tabular grain silver halide emulsion layer units coated on opposite sides of the film support.

At least one and preferably both of the emulsion layer units is comprised of a silver halide emulsion layer containing spectrally sensitized silver halide grains and a dispersing medium. Thin tabular silver halide grains (those having a thickness of less than 0.2 micrometer) account for greater than 50 percent of total grain projected area and exhibit an average tabularity of greater than 25. By employing thin tabular grains higher covering power is achieved. For a further description of covering power attention is directed to Dickerson U.S. Pat. No. 4,414,304, the disclosure of which is here incorporated by reference. Employing thin tabular grains also works to increase tabularity (see relationship R1 above) and the advantages known to be produced by high tabularity. To increase the advantages imparted to the emulsion by the thin tabular grains it is preferred that the thin tabular grains account for at least 70 percent and optimally at least 90 percent of the total grain projected area. While specific advantages can be realized by blending other silver halide grain populations with the thin tabular grains, it is generally preferred to prepare the thin tabular grain emulsions with the highest attainable proportion of thin tabular grains, based on total grain projected area.

To achieve the highest attainable sensitivity from the thin tabular grain, high tabularity silver halide emulsions in the mid-green region of the spectrum one or a combination low staining spectral sensitizing dyes exhibiting an absorption peak in the mid-green spectral region is adsorbed to the surfaces of the silver halide grains. To realize a significant mid-green speed enhancement it is contemplated to incorporate in the emulsions sufficient mid-green absorbing spectral sensitizing dye to provide a monomolecular coverage of at least 35 percent of the total grain surface area. This value is calculated from a knowledge of the grain surface area and the dimensions of the adsorbed dye molecule. If a dye is known to aggregate, monomolecular coverage is based on the grain surface area occupied by each dye molecule in its aggregated state. As is generally well understood in the art excessive amounts of dye can desensitize the emulsions. Generally maximum sensitivity levels are attained with monomolecular dye concentrations ranging from 45 to 100 percent of total grain surface area.

It has been discovered quite unexpectedly that the thin, high tabularity silver halide emulsions employed in the radiographic elements of this invention can be efficiently sensitized in the mid-green spectral region while achieving high levels of stability on storage and low levels of dye stain in the fully processed film. These advantageous properties are achieved by employing for spectral sensitization benzimidazolocarbocyanine dyes of the following formula I:

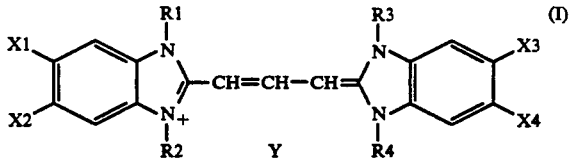

where

R1 and R3 are methyl or ethyl, at least one of R1 and R3 being methyl;

R2 and R4 are substituted or unsubstituted $C_1$ to $C_6$ alkyl, provided that R2 and R4 are not both methyl;

X1, X2, X3, and X4 are each independently methyl, methylthio, fluoro-substituted methyl or methylthio, or hydrogen, provided that at least one of X1 and X2 and at least one of X3 and X4 are not hydrogen; and Y represents an ion as needed to balance the charge of the molecule. The dyes of formula I when adsorbed to the surface of silver halide grains form J-aggregates exhibiting peak absorption in the 540–555 nm region of the spectrum, whereas, conventional benzimidiazolocarbocyanine dyes produce J-aggregates that exhibit longer wavelength absorption peaks.

In formula I above, R2 and R4 are defined as substituted or unsubstituted $C_1$ to $C_6$ alkyl. Examples of unsubstituted R2 and R4 include lower alkyls such as methyl, ethyl, propyl, butyl, pentyl, and hexyl. Examples of substituents include one or more of sulfo, sulfato, carboxyl, fluoro, amides, esters, cyano, substituted or unsubstituted aryls, and other substituents commonly used in photographic sensitizing dyes. Examples of substituted alkyl R2 and R4 include sulfopropyl, sulfobutyl, trifluoroethyl, allyl, 2-butynyl, N,N-dimethylcarbamoylmethyl, methylsulfonylcarbamoylmethyl, sulfoethylcarbamoylmethyl, cyanoethyl, cyanomethyl, ethoxycarbonylmethyl, etc.

X1 through X4 are each methyl, methylthio, fluoro-substituted methyl or methylthio, or hydrogen. Examples of fluoro-substituted methyl and methylthio are fluoromethyl, difluoromethyl, trifluoromethyl, fluoromethylthio, difluoromethylthio, and trifluoromethylthio.

Depending upon substituents R2 and R4, a counter ion Y may be necessary to balance the charge of the dye molecule. Such counter ions are well known in the art and examples thereof include cations such as sodium, potassium, triethylammonium, and the like, and anions such as chloride, bromide, iodide, $BF_4$, and the like. The dye chromophore itself provides a positive charge, so that if no ionic substituents are present a anionic counter ion is required to complete the dye molecule. On the other hand, if one of the substituents is anionic, then the dye as a whole is a zwitterion and requires no counter ion. If the dye contains two anionic substituents, a cation is again required as a counter ion.

Examples of compounds according to formula I include the dyes of Table I below.

TABLE I

| Dye | R1 | R2 | R3 | R4 | X1 | X2 | X3 | X4 |
|---|---|---|---|---|---|---|---|---|
| I-1 | Me | Sp⁻ | Me | SP⁻ | H | SMe | H | SMe |
| I-2 | Me | Et | Me | Et | H | SMe | H | SMe |
| I-3 | Me | Me | Me | SP⁻ | Me | Me | H | $CF_3$ |
| I-4 | Et | SP⁻ | Me | Et | H | $CF_3$ | Me | Me |
| I-5 | Et | SP⁻ | Me | Me | H | $CF_3$ | H | Me |
| I-6 | Me | Et | Me | SP⁻ | H | SMe | H | $CF_3$ |
| I-7 | Me | SP⁻ | Me | Et | H | $CF_3$ | H | $CF_3$ |
| I-8 | Et | Et | Me | SP⁻ | H | $CF_3$ | H | $CF_3$ |
| I-9 | Me | TFE | Me | SP⁻ | H | $CF_3$ | H | $CF_3$ |
| I-10 | Me | SP⁻ | Me | SP⁻ | H | $CF_3$ | H | $CF_3$ |
| I-11 | Et | TFE | Me | SP⁻ | H | $CF_3$ | H | $CF_3$ |
| I-12 | Me | TFE | Me | TFE | H | $CF_3$ | H | $CF_3$ |
| I-13 | Me | Et | Me | Et | SMe | $CF_3$ | SMe | $CF_3$ |
| I-14 | Me | $CH_2COOMe$ | Me | SP⁻ | H | $CF_3$ | H | $CF_3$ |
| I-15 | Et | $CH_2COOMe$ | Me | SP⁻ | H | $CF_3$ | H | $CF_3$ |
| I-16 | Me | $CH_2COOMe$ | Et | SP⁻ | H | $CF_3$ | H | $CF_3$ |
| I-17 | Et | $CH_2CONH_2$ | Me | SP⁻ | H | $CF_3$ | H | $CF_3$ |
| I-18 | Et | $CH_2COOEt$ | Me | SP⁻ | H | $CF_3$ | H | $CF_3$ |
| I-19 | Et | $CH_2COOPr$ | Me | SP⁻ | H | $CF_3$ | H | $CF_3$ |
| I-20 | Et | $CH_2CONMe_2$ | Me | SP⁻ | H | $CF_3$ | H | $CF_3$ |
| I-21 | Me | SECM⁻ | Me | TFE | SMe | $CF_3$ | SMe | $CF_3$ |
| I-22 | Me | TFE | Et | TFE | Me | $CF_3$ | Me | $CF_3$ |
| I-23 | Me | $CH_2CN$ | Et | SP⁻ | H | $CF_3$ | H | $CF_3$ |
| I-24 | Me | Et | Me | Et | $CF_3$ | $CF_3$ | $CF_3$ | $CF_3$ |
| I-25 | Me | TFE | Me | $CH_2COOMe$ | Me | $CF_3$ | Me | $CF_3$ |
| I-26 | Me | SECM⁻ | Me | Et | H | $CF_3$ | H | $CF_3$ |
| I-27 | Me | TFE | Me | 4SB⁻ | H | $CF_3$ | H | $CF_3$ |
| I-28 | Me | TFE | Me | 3SB⁻ | H | $CF_3$ | H | $CF_3$ |
| I-29 | Me | TFE | Me | SE⁻ | H | $CF_3$ | H | $CF_3$ |
| I-30 | Me | TFE | me | MSCM⁻ | H | $CF_3$ | H | $CF_3$ |

Me — Methyl
Et — Ethyl
TFE — Trifluoroethyl
SE⁻ — Sulfoethyl
SP⁻ — Sulfopropyl
MSCM⁻ — Methylsulfonylcarbamoylmethyl
SECM⁻ — sulfoethylcarbamoylmethyl
SMe — Methylthio
3SB⁻ — 3-sulfobutyl
4SB⁻ — 4-sulfobutyl Dye I-1 has a potassium counter ion Y, dyes I-2, I-13, I-22 and I-24 have p-toluene sulfonate counter ions Y, dye I-10 has a sodium counter ion Y, dye I-12 has a fluoroborate counter ion Y, and dye I-25 has a bromide counter ion Y associated therewith. The particular counter ion is not critical, however, and other counter ions can, if desired, be selected from among the exemplary counter ion listed above.

In a preferred embodiment, the combination of substituents R1–R4 and X1–X4 are selected to fit the following equation (i):

$$0.455\Sigma\sigma_i(R1\text{–}R4)+0.144\Sigma\rho_p(X1\text{–}X4)+0.610\leq 0.68 \quad \text{(i)}$$

where the small sigmas are electronic substituent constants, $\sigma_i$ being Taft's sigma(inductive) constant, and $\sigma_p$ being Hammett's sigma(para) constant. It has been found that dyes with an oxidation potential greater than or equal to 0.68 are more stable toward speed loss in a stored photographic element. Equation (i) is a quantitative expression for the oxidation potential of a benzimidazolocarbocyanine dye based on its chemical structure. Values for the above constants and a discussion of their meaning can be found in Hansch and Leo, *Substituent Constants for Correlation Analysis in Chemistry and Biology*, John Wiley & Sons, New York 1979, the disclosure of which is incorporated by reference. As shown in examples 2 and 3 below, when substituents R1 through R4 and X1 through X4 are chosen so that the sum of their Taft's sigma(inductive) constants and Hammett's sigma(para) constants fit equation (i), speed loss due to oxidative instability can be avoided.

The dyes of formula I can be prepared according to techniques that are wellknown in the art, such as described in Hamer, *Cyanine Dyes and Related Compounds*, 1964 and James, *The Theory of the Photographic Process* 4th, 1977.

Apart from the features specifically described above the dual coated radiographic elements of the invention can take any convenient conventional form. The remaining features of the radiographic elements in specifically preferred forms are selected according to the teachings of Abbott et al U.S. Pat. Nos. 4,425,425 and 4,425,426 and Dickerson et al U.S. Pat. Nos. 4,803,150 and 4,900,652, the disclosures of which are here incorporated by reference.

The silver halide grains are preferably silver bromide grains optionally containing iodide in concentrations up to about 6 mole percent, optimally less than 3 mole percent, based on total silver. Limiting iodide concentrations allows very rapid rates of processing to be realized.

The silver halide to be used for image formation is preferably chemically sensitized. Preferred chemical sensitization techniques employ sulfur and/or gold sensitizers. It is also possible to chemically sensitize the tabular grains with edge and/or corner epitaxial deposition of a silver salt, such as silver chloride. Conventional techniques for chemical sensitization are summarized in Section III of *Research Disclosure*, Vol. 308, December 1989, Item 308119, hereinafter referred to as *Research Disclosure* I. *Research Disclosure* is published by Kenneth Mason Publications, Ltd., Dudley Annex, 21a North Street, Emsworth, Hampshire P010 70Q, England.

The silver halide emulsions can be sensitized by the dye of formula I by any method known in the art, such as described in Section VI of *Research Disclosure* I. The dye maybe added to an emulsion of the silver halide grains and a hydrophilic colloid at any time prior to (e.g., during or after chemical sensitization) or simultaneous with the coating of the emulsion on a photographic element.

The various layers of the radiographic elements that are intended to be penetrated by processing solutions, including the emulsion layers, underlying crossover reducing layers when present, and protective overcoat layers preferably contain one or more hydrophilic colloids serving as vehicles. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as well as optional vehicle extenders, as described in Section IX of *Research Disclosure* I.

The radiographic elements preferably additionally include various conventional photographic addenda, such as antifoggants, stabilizers, filter dyes, light absorbing or reflecting pigments, vehicle hardeners such as gelatin hardeners, and coating aids. These addenda and methods of their inclusion in the radiographic elements are well known in the art and are disclosed in *Research Disclosure* I and *Research Disclosure* Vol 184 August 1979, Item 18431 (*Research Disclosure* II) and the references cited therein.

The film supports onto which the various layers are coated forming the radiographic elements can take any convenient conventional form. Typical film supports are disclosed by *Research Disclosure* II, Section XII, the disclosure of which is here specifically poly(ethylene terephthalate) film supports, are preferred. The film supports are transparent, and are often tinted blue for aesthetic appeal to viewers.

The radiographic elements are preferably constructed for rapid access processing. Typically rapid access processing occurs in 90 seconds or less. Preferred rapid access processing is disclosed by the patents of Abbott et al and Dickerson et al cited above.

EXAMPLES

The invention is further illustrated by the following specific embodiments.

EXAMPLE 1

Synthesis of Dye I-12 a) 1,2-Dimethyl-5-trifluoromethylbenzimidazole (5.35 g, 0.025 mole) and 2,2,2-trifluoroethyl trifluoromethanesulfonate (6.5 mL, 0.044 mole) were combined in 20 mL of toluene. The mixture was heated at 105° C. for 27 hours. The product, 1,2-dimethyl-3-(2,2,2-trifluoroethyl)-5-trifluoromethylbenzimidazolium trifluoromethanesulfonate, separated as an oil which crystallized upon cooling. The yield was 9.9 g. 0.022 mole, 89%.

b) 1,2-Dimethyl-3-(2,2,2-trifluoroethyl)-5-trifluoromethylbenzimidazolium trifluoromethanesulfonate (4.02 g,0.009 mole) was dissolved in 15 mL of dimethylformamide. Diethoxymethyl acetate (1.1 mL, 0.0067 mole) and 1,8-diazabicyclo[5.4.0]undec-7-ene (1.0 mL, 0.0067 mole) were added and the mixture was heated to reflux for 10 minutes. Excess sodium fluoroborate in methanol solution was added to the cooled reaction mixture to precipitate dye I12. The yield was 2.1 g, 0.0030 mole, 67%. The dye could be recrystallized from a mixture of ethanol and acetonitrile. Lambda max (methanol): 492 nm. Extinction coefficient: 169,000 L/mole-cm.

Analysis: Calculated for $C_{25}H_{19}BF_{16}N_4$: 43.5% C, 2.8% H, 8.1% N, Found: 43.4% C, 2.7% H, 8.0% N.

EXAMPLE 2

Synthesis of Dye I-17

3Carbamoylmethyl-1-ethyl-2-methyl-5-trifluoromethylbenzimidazolium chloride (1.61 g, 0.005 mole) and anhydro-2-acetanilidovinyl-1-methyl-3-(3-sulfopropyl)-5-trifluoromethylbenzimidazolium hydroxide (2.40 g, 0.005 mole) were suspended in 35 mL of acetonitrile. 1,8-Diazabicyclo[5.4.0]-undec-7-ene (0.80 mL, 0.0054 mole) was added and the mixture was heated to reflux over 15 minutes. Reflux was maintained for 25 minutes and dye separated from the reaction mixture. After cooling the solid dye I-17 was collected. The yield was 1.95 g, 0.0031 mole, 62%. Lambda max (methanol): 497 nm. Extinction coefficient: 165,000 L/mole-cm.

Analysis: Calculated for $C_{27}H_{27}F_6N_5O_4S$: 51.4% C, 4.3% H, 11.1% N, Found: 51.1% C, 4.3% H, 11.2% N.

EXAMPLE 3

A thin (t=0.13 micrometer) tabular grain, high tabularity (T=101) silver bromide emulsion (1.7 micrometers equivalent circular diameter) chemically sensitized with 3.5 mg potassium tetrachloroaurate, 0.45 mg potassium selenocyanate, 3.4 mg sodium thiosulfate, and 20 mg sodium thiocyanate per mole of silver was dyed with either 0.5 or 0.75 mmoles dye/mole silver. Dyes I-4 and I-11 of Table I above and comparison dyes A and B (illustrated below) were evaluated. Tetraazaindene (2.1 g/mole Ag) was also added as an antifoggant. The emulsion was coated on Estar TM poly(ethylene terephthalate) transparent film support at a level of 42 mg/dm$^2$ (390 mg/ft$^2$) gel and 21.5 mg/dm$^2$ (200 mg/ft$^2$) silver with 1% bis(vinylsulfonylmethyl) ether hardener and 1% saponin as a spreading agent. Strips were given a 1/50" wedge spectral exposure and processed in a Kodak RP X-OMAT TM rapid access processor. Speed was measured at a density of 0.3 above Dmin. One set of strips were incubated for one week at 49° C., 50% Relative Humidity, and processed again to compare fog growth. The following results were obtained (Table II).

TABLE II

| Dye | mmole/ mole Ag | Speed | Sens. Peak | Fog (Init.) | Fog (After 1 wk. inc.) | Equation (i) value |
|---|---|---|---|---|---|---|
| A | 0.5 | 224 | 570 | 0.11 | 0.55 | 0.514 |
| | 0.75 | 235 | 570 | 0.16 | 0.95 | |
| B | 0.5 | 213 | 570 | 0.14 | 0.23 | 0.523 |
| | 0.75 | 232 | 570 | 0.16 | 0.37 | |
| I-4 | 0.5 | 231 | 550 | 0.09 | 0.14 | 0.530 |
| | 0.75 | 239 | 550 | 0.08 | 0.22 | |
| I-11 | 0.5 | 282 | 550 | 0.05 | 0.06 | 0.743 |
| | 0.75 | 284 | 550 | 0.08 | 0.07 | |

(A)

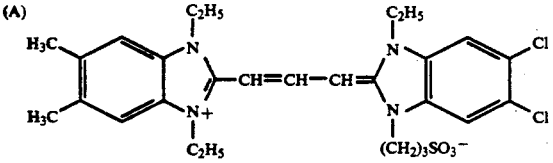

(B)

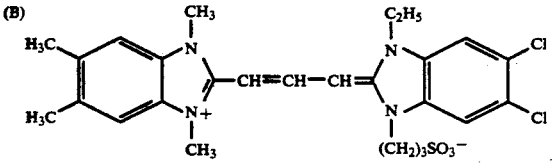

Equation (i) values were calculated using the $\sigma_i$ values for Me (−0.04), Et (−0.05), TFE (+0.14), SP−(−0.1), 3SB$^-$ (−0.1) and allyl (0); and $\sigma_p$ values for Me (−0.17), Cl (+0.23), H (0), $CF_3$ (+0.54), and SMe (0).

The dyes which had values of less than 0.68 from equation (i) showed substantial fog growth while the dyes conforming to the requirements of the invention having a value greater than 0.68 in accordance with equation (i) not only sensitized at 550 nm, but showed no fog growth at all.

EXAMPLE 4

The purpose of this example is to demonstrate the significant reduction in dye stain obtainable in a dual coated radiographic element by substituting a dye satisfying the requirements of the invention for a conventional spectral sensitizing dye.

Except as otherwise indicated the construction of the dual coated radiographic elements, their exposure and rapid access processing was as described in Dickerson et al U.S. Pat. No. 4,900,652, Examples 1–6 using element C-O.

Whereas Dickerson et al used a blue emitting intensifying screen and relied upon native silver halide sensitivity, in these comparative examples gadolinium oxysulfide phosphor containing intensifying screens were employed to provide peak emission at 545 nm, dual [illegible] were compared containing a standard commercial spectral sensitizing dye and a spectral sensitizing dye satisfying the requirements of the invention.

A first control dual coated radiographic element differed from element C-O of Dickerson U.S. Pat. No. 4,900,652, in that a thin (t =0.13 micrometer), high tabularity (T=118) emulsion was coated at a silver coverage of 24.2 mg/dm$^2$ and a gelatin coverage of 29 mg/dm$^2$. The gelatin overcoat coverage was 6.9 mg/dm$^2$ and the hardener level was 1.5% of the gelatin. The spectral sensitizing dye employed was anhydro-5,5'-dichloro-9-ethyl-3,3'-di(3-sulfopropyl)oxacarbocyanine hydroxide, sodium salt. When the dye was employed at a level of 400 mg/Ag mole (corresponding to a monomolecular coverage of 55% of total silver surface area), maximum density was found to be 3.9 and residual density in Dmin areas attributable to dye stain was found to be 0.08.

A second control was constructed similarly as the first control, but with a thinner tabular grain emulsion substituted. The silver coverage was reduced to 19.4 mg/dm$^2$ while dye coverage was increased to 800 mg/Ag mole (corresponding to a monomolecular coverage of 78% of total silver surface area). Mean tabular grain thickness was 0.085 micrometer and mean tabularity (T) was 249. Maximum density increased slightly to 4.0 while dye stain doubled, increasing to 0.16.

When a dual coated radiographic element was constructed satisfying the requirements of the invention simply by substituting dye I-11 in the same concentration for the dye in the second control, maximum density remained unchanged while no minimum density attributable to dye stain was observed. This demonstrated a dramatic reduction in dye stain.

The invention has been described in detail with particular reference to preferred embodiments thereof, but it will be understood that variations and modifications can be effected within the spirit and scope of the invention.

What is claimed:

1. A radiographic element comprised of a transparent film support and spectrally sensitized tabular grain silver halide emulsion layer units coated on opposite sides of the film support,

CHARACTERIZED IN THAT at least one of the emulsion layer units is comprised of tabular grains having a thickness of less than 0.2 micrometer accounting for greater than 50 percent of total grain projected area and exhibiting an average tabularity of greater than 25 and adsorbed to the surface of the tubular grains at least one benzimidazolocarbocyanine dye of the formula:

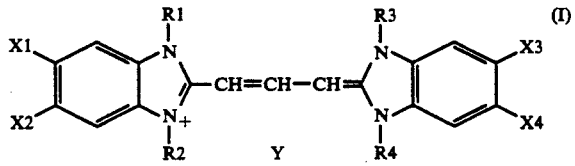

(I)

where

R1 and R3 are methyl or ethyl, at least one of R1 and R3 being methyl;

R2 and R4 are substituted or unsubstituted $C_1$ to $C_6$ alkyl, provided that at least one of R2 and R4 is fluorsubstituted alkyl;

X1 and X3 are each independently methyl, methylthio, fluoro-substituted methyl or methylthio, or hydrogen;

X2 and X4 are each fluoro-substituted methyl and

Y represents an ion as needed to balance the charge of the molecule.

2. A radiographic element according to claim 1 further characterized in that the dye is adsorbed to the surface of the grains in an amount sufficient to provide a monomolecular coverage of the grain surface area of at least 30 percent of total grain surface area.

3. A radiographic element according to claim 2 further characterized in that the dye is adsorbed to the surface of the grains in an amount sufficient to provide a monomolecular coverage of the grain surface area of from 40 to 100 percent of total grain surface area.

4. A radiographic element according to claim 1 further characterized in that the emulsion layer units on opposite major surfaces of the support are identical.

5. A radiographic element according to claim 1 further characterized in that the support is a blue tinted poly(ethylene terephthalate) film support.

6. A radiographic element according to claim 1 wherein R1 and R3 are each methyl.

7. A radiographic element according to claim 1 wherein R1 is methyl and R3 is ethyl.

8. A radiographic element according to claim 1 wherein at least one of X1, X2, X3 and X4 is trifluoromethyl.

9. A radiographic element according to claim 1 wherein at least one of R2 and R4 is sulfoalkyl.

10. A radiographic element according to claim 1 wherein each of X2 and X4 is trifluoromethyl.

11. A radiographic element according to claim 6 wherein at least one of R2 and R4 is trifluoroethyl.

12. A radiographic element according to claim 1 wherein the combination of substituents R1–R4 and X1–X4 are selected to fit the following equation (i)P $$0.455\Sigma\sigma_i(R1\text{–}R4)+0.144\Sigma\sigma_p(X1\text{–}X4)+0.610\leqq 0.68 \qquad \text{(i)}$$

where the small sigmas are electronic substituent constants, $\sigma_i$ being Taft's sigma(inductive) constant, and $\sigma_p$ being Hammett's sigma(para) constant.

* * * * *